US006843558B2

(12) United States Patent
Seino

(10) Patent No.: US 6,843,558 B2
(45) Date of Patent: Jan. 18, 2005

(54) LIQUID CARTRIDGE AND LIQUID ACCOMMODATING MEMBER

(75) Inventor: Takeo Seino, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 21 days.

(21) Appl. No.: 10/615,118

(22) Filed: Jul. 8, 2003

(65) Prior Publication Data

US 2004/0056934 A1 Mar. 25, 2004

(30) Foreign Application Priority Data

Jul. 9, 2002 (JP) ..... 2002-200594
Jul. 1, 2003 (JP) ..... 2003-189804

(51) Int. Cl.[7] ..... B41J 2/175
(52) U.S. Cl. ..... 347/85; 347/86
(58) Field of Search ..... 348/85, 86; 141/24; 137/68.14, 527.6, 528, 535; 222/92, 109, 110

(56) References Cited

U.S. PATENT DOCUMENTS 4,882,596 A * 11/1989 Tsuzuki et al. ..... 347/10
4,940,997 A * 7/1990 Hamlin et al. ..... 347/87
5,912,688 A 6/1999 Gragg
6,033,061 A 3/2000 Niedermeyer et al.
6,145,971 A * 11/2000 Baker et al. ..... 347/85
6,164,766 A * 12/2000 Erickson ..... 347/85
6,172,694 B1 * 1/2001 Droege et al. ..... 347/85
6,193,364 B1 * 2/2001 Iida ..... 347/86
6,224,198 B1 * 5/2001 Cook et al. ..... 347/85
6,322,205 B1 * 11/2001 Childers et al. ..... 347/85
6,481,837 B1 * 11/2002 Askren et al. ..... 347/85

OTHER PUBLICATIONS

Search Report from corresponding European Pat. Appln. 03 01 4593.2, dated Jun. 14, 2004.

* cited by examiner

*Primary Examiner*—Anh T. N. Vo
(74) *Attorney, Agent, or Firm*—Stroock & Stroock & Lavan LLP

(57) ABSTRACT

A liquid cartridge for supplying liquid to a liquid ejecting apparatus, includes: a liquid accommodating part for holding the liquid; a channel for allowing the liquid in the liquid accommodating part to flow to the outside of the liquid accommodating part; and a check valve for preventing air from getting into the liquid accommodating part via the channel in a case where the channel is opened to the atmosphere with the channel faced upward and allowing backward flow of liquid from the liquid ejecting apparatus to the liquid accommodating part while the channel is connected to the liquid ejecting apparatus.

14 Claims, 11 Drawing Sheets

LIQUID CARTRIDGE AND LIQUID ACCOMMODATING MEMBER

This patent application claims priority from Japanese patent applications Nos. 2002-200594 filed on Jul. 9, 2002 and 2003-189804 filed on Jul. 1, 2003, the contents of which are incorporated herein by reference.

BACKGROUND OF THE INVENTION

1. Field of the Invention

The present invention relates to a liquid cartridge that is mounted on a liquid ejecting apparatus to supply liquid to a liquid ejecting head. More particularly, the present invention relates to an ink cartridge that is mounted on an ink-jet recording apparatus to supply ink to a recording head of the ink-jet recording apparatus.

2. Description of the Related Art

An ink cartridge as an exemplary liquid cartridge for supplying ink to an ink-jet recording apparatus as an exemplary liquid ejecting apparatus holds the ink therein. The ink cartridge supplies the ink to a recording head of the ink-jet recording apparatus by being mounted onto the main body of the ink-jet recording apparatus, so as to record information such as characters, images and the like, on a recording medium such as paper.

FIGS. 1A and 1B are a perspective view of the aforementioned ink-jet recording apparatus 10 and an approximately front view thereof showing an ink transfer path 203.

In the ink-jet recording apparatus 10 shown in FIGS. 1A and 1B, the ink transfer path 203 connects a plurality of ink cartridges 300 mounted on a cartridge holder 200 to a carriage 201. Ink accommodated in each ink cartridge 300 is supplied to a recording head 205 that is provided on the carriage 201 and can be moved together with the carriage 201, through a flexible tube serving as the ink transfer path 203 by request from the carriage 201.

More specifically, the ink-jet recording apparatus 10 shown in FIGS. 1A and 1B includes the main body 100 and the cartridge holder 200 provided in a part of the main body 100, on which the ink cartridges 300 are to be mounted. The cartridge holder 200 has a cover 202 that is pivotable in a direction indicated with a double-headed arrow in FIG. 1A. An example of the ink-jet recording apparatus 10 is a large-sized ink-jet printer that can perform recording for large-sized paper (A2 size to A0 size, for example) such as poster, by using a large amount of ink. The ink-jet recording apparatus 10 supplies the ink in the ink cartridge 300 incorporated in the cartridge holder 200 to the recording head 205 mounted on the carriage 201 through the ink transfer path 203 such as a flexible tube, as shown in FIG. 1B, and causes the recording head 205 to emit the ink while the carriage 201 is being scanned, thereby performing the recording for paper supplied to the ink-jet recording apparatus 10.

With the scan of the carriage 201 in the scanning direction (horizontal direction in FIG. 1B) during the printing operation, the ink transfer path 203 is bent and extended. Such extending and bending of the ink transfer path 203 causes the ink in the ink transfer path 203 to flow in a direction of ink supply toward the carriage 201 (hereinafter, referred to as a forward direction) or in the opposite direction to the forward direction. The ink flow in the forward direction or backward direction causes the ink in the flexible tube of the ink transfer path 203 to apply positive or negative pressure to the recording head 205.

As the ink cartridge 300 used in this type of ink-jet recording apparatus 10, an ink cartridge has been proposed that has a check valve for allowing ink flow in the ink supply direction but preventing ink flow in the opposite direction to the ink supply direction. In a case of this type of ink cartridge 300, with the extending and bending of the ink transfer path 203, the ink is supplied from the ink cartridge 300 to the recording head 205 when the flow velocity is given in the ink supply direction, whereas the check valve is arranged to completely close the ink flow path in the ink cartridge 300 when the flow velocity is given in the opposite direction to the ink supply direction. Thus, in a case of using the conventional check valve, the ink cannot flow back from the recording head 205 to the ink cartridge 300. In the ink-jet recording apparatus 10 using the ink cartridge 300 having the check valve of the above structure, when the extending/bending of the ink transfer path 203 described above is repeated during the printing operation, the ink is oversupplied to the recording head 205, which may cause an ink drop to fall from a nozzle of the recording head 205. Moreover, in a case where the moving speed of the carriage 201 is increased to increase the printing speed, the ink pressure may be increased to damage the recording head 205.

On the other hand, as another type of conventional ink cartridge, an ink cartridge is known that has a supply valve in a channel in which the ink cartridge is connected to the ink-jet recording apparatus 10, in order to allow ink to be supplied while the ink cartridge is connected to the ink-jet recording apparatus 10 and to prevent the ink from leaking to the outside while the ink cartridge is not connected to the ink-jet recording apparatus 10.

In such an ink cartridge, however, air from the outside may get into an ink accommodating part of the ink cartridge when a user forcedly opens the supply valve to the outside by using a projection such as a pen tip. Once the air got into the ink accommodating part, even if the ink cartridge has been mounted onto the ink-jet recording apparatus 10 thereafter, the air may obstruct the ink flow in the ink flow path. In addition, when air bubble reached the recording head 205, it may prevent ink emission from the nozzle, that is, may cause dot defect, leading to defective printing. As a result, the ink may not be supplied in an appropriate manner even if the ink cartridge is connected to the ink-jet recording apparatus 10.

SUMMARY OF THE INVENTION

Therefore, it is an object of the present invention to provide a liquid cartridge and a liquid accommodating member, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, a liquid cartridge for supplying liquid held therein to a liquid ejecting apparatus, comprises: a liquid accommodating part operable to hold liquid; a channel operable to communicate with the liquid accommodating part to allow the liquid accommodated in the liquid accommodating part to flow to an outside of the ink accommodating part; and a check valve, provided in the channel, operable to prevent air from getting into the liquid accommodating part via the channel in a case where the channel is opened to atmosphere with the channel faced upward, and to allow backward flow of the ink from the liquid ejecting recording apparatus to the liquid accommodating part while the channel is connected to the liquid ejecting apparatus. Thus, it is possible to allow the backward flow of liquid to the liquid accommodating part caused by extending/bending of a liquid transfer path while the liquid cartridge is connected to the liquid ejecting apparatus, and is also possible to prevent oversupply of the liquid to the main body of the liquid ejecting apparatus, which may cause falling of ink drops from an ejection head or a damage of the ejection head by increased pressure of the liquid.

According to the second aspect of the present invention, a liquid cartridge for supplying liquid held therein to a liquid ejecting apparatus, comprises: a liquid accommodating part operable to hold liquid; a channel, having an accommodating-part opening that can communicate with an inside of the liquid accommodating part and an external opening that can communicate with the liquid ejecting apparatus, operable to allow the liquid in the liquid accommodating part to flow to the liquid ejecting apparatus; a check valve having a valve main body and a guide, the valve main body preventing air from getting into the liquid accommodating part via the channel by moving in a direction opposite to a direction of liquid supply to close the accommodating-part opening, the guide extending from the valve main body in the direction of liquid supply by a distance longer than a movable distance of the valve main body; and a guide holding portion, provided in the channel between the accommodating-part opening and the external opening, operable to hold the guide slidably in the liquid supply direction and the opposite direction to the liquid supply direction. Thus, the same effect as that obtained by the first aspect of the present invention can be obtained.

The liquid cartridge may further comprise a detour path operable to allow communication between the accommodating-part opening and the external opening in a state where the valve main body of the check valve does not close the accommodating-part opening. Thus, while the liquid cartridge is connected to the liquid ejecting apparatus, it is possible to allow the backward flow of liquid toward the liquid accommodating part caused by extending/bending of the liquid transfer path more surely.

The guide holding portion may come into contact with the valve main body when the check valve moved in the liquid supply direction, to prevent the liquid flowing backward from moving the check valve in the opposite direction to the liquid supply direction. Thus, in a case where backward flow of liquid toward the liquid accommodating part occurs with extending/bending of the liquid transfer path, it is possible to prevent the check valve from closing the accommodating-part opening, thereby allowing the backward flow of liquid more surely.

The check valve may be formed of material having larger specific gravity than material for the liquid. In this case, the check valve rapidly closes the accommodating-part opening when the channel has been opened to the atmosphere with the channel faced upward. Therefore, it is possible to prevent air from getting into the liquid accommodating part via the channel more surely.

The check valve may be formed of material having higher melting point than materials for the channel and the liquid accommodating part. Thus, it is possible to weld the channel and the liquid accommodating part by heat with the check valve accommodated in the channel.

The check valve may be formed of polypropylene and the channel and the liquid accommodating part are formed of polyethylene. In this case, since melting point of the check valve is higher than that of the channel, it is possible to weld the channel and the liquid accommodating part by heat with the check valve accommodated in the channel.

The guide may project from the guide holding portion toward the external opening at least when the check valve moved in the liquid supply direction, and the channel may have a larger cross-sectional area on an external-opening side of the guide holding portion than on an accommodating-part-opening side of the guide holding portion. In this case, since the flow velocity in the channel is smaller on the external-opening side than on the accommodating-part-opening side, it is harder to move the check valve toward the accommodating-part opening when the liquid flows in the backward direction. Therefore, it is possible to surely allow the backward flow of liquid.

The liquid cartridge may further comprise a supply valve, arranged in the channel on an external-opening side of the check valve, operable to supply the liquid to the liquid ejecting apparatus by receiving a liquid-supply needle of the liquid ejecting apparatus inserted thereto. Thus, it is possible to surely prevent the liquid from leaking to the outside via the external opening while the liquid cartridge is not connected to the liquid ejecting apparatus.

The valve main body may have a contact surface capable of coming into contact with the accommodating-part opening. In this case, when the check valve has been moved toward the accommodating-part opening, it is possible to surely close the accommodating-part opening with the contact surface of the check valve.

The contact surface may have a projection tapered off toward the accommodating-part opening. Thus, when the check valve has been moved toward the accommodating-part opening, the projection enters the accommodating-part opening. Therefore, it is possible to guide the check valve in such a manner that the contact surface of the check valve surely closes the accommodating-part opening.

The contact surface may have a curved surface that becomes convex toward the accommodating-part opening. In this case, the pressure for sealing the accommodating-part opening with the contact surface of the check valve can be increased because the contact area between the contact surface of the check valve and the periphery of the accommodating-part opening is reduced. Further, the periphery of the accommodating-part opening is evenly pressed, so that the contact surface the accommodating-part opening are more steadily brought into contact with each other. Therefore, it is possible to prevent air from getting into the inside more effectively.

According to the third aspect of the present invention, a liquid accommodating member for supplying liquid to a liquid ejecting apparatus, comprises: a flexible main body operable to hold liquid; a channel, provided in the flexible main body, operable to allow the liquid to flow to an outside of the flexible main body; and a check valve, provided in the channel, operable to prevent air from getting into the flexible main body via the channel in a case where the channel is opened with the channel faced upward, and to allow backward flow of the liquid from the liquid ejecting apparatus to the flexible main body while the channel is connected to the liquid ejecting apparatus. Thus, the same effect as that obtained by the first aspect of the present invention can be obtained.

According to the fourth aspect of the present invention, a liquid cartridge for supplying liquid accommodated therein to a liquid ejecting apparatus, comprises: a box-like cartridge main body operable to be removably attached to the liquid ejecting apparatus; a flexible liquid accommodating part, accommodated in the cartridge main body, operable to hold the liquid; a channel operable to communicate with an inside of the liquid accommodating part to allow the liquid accommodated in the liquid accommodating part to flow to an outside of the liquid accommodating part; and a check valve, provided in the channel, operable to prevent air from getting into the liquid accommodating part via the channel in a case where the channel is opened to atmosphere with the channel faced upward, and to allow backward flow of the liquid from the liquid ejecting apparatus to the liquid accommodating part while the channel is connected to the liquid ejecting apparatus. Thus, the same effect as that obtained by the first aspect of the present invention can be obtained.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1A:
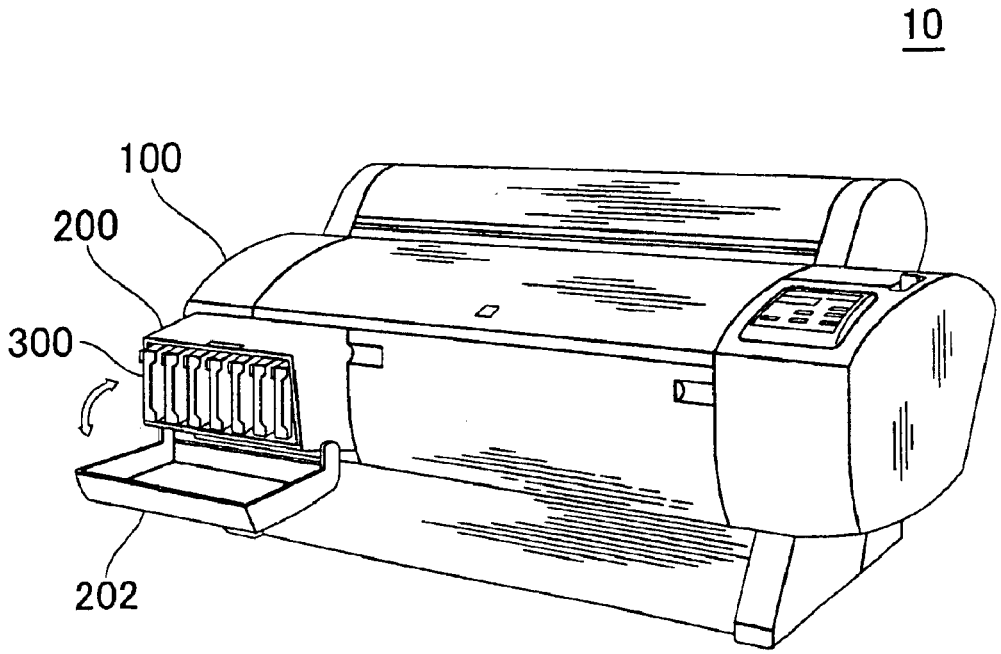
FIG. 1A is a perspective view of an ink-jet recording apparatus.
Figure 1B:
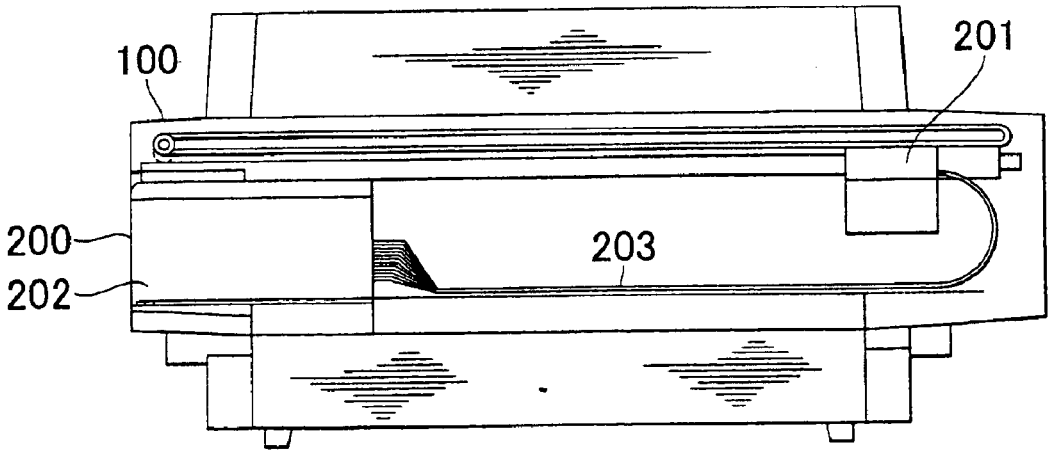
FIG. 1B is an approximately front view of the ink-jet recording apparatus, showing an ink transfer path.
Figure 2:
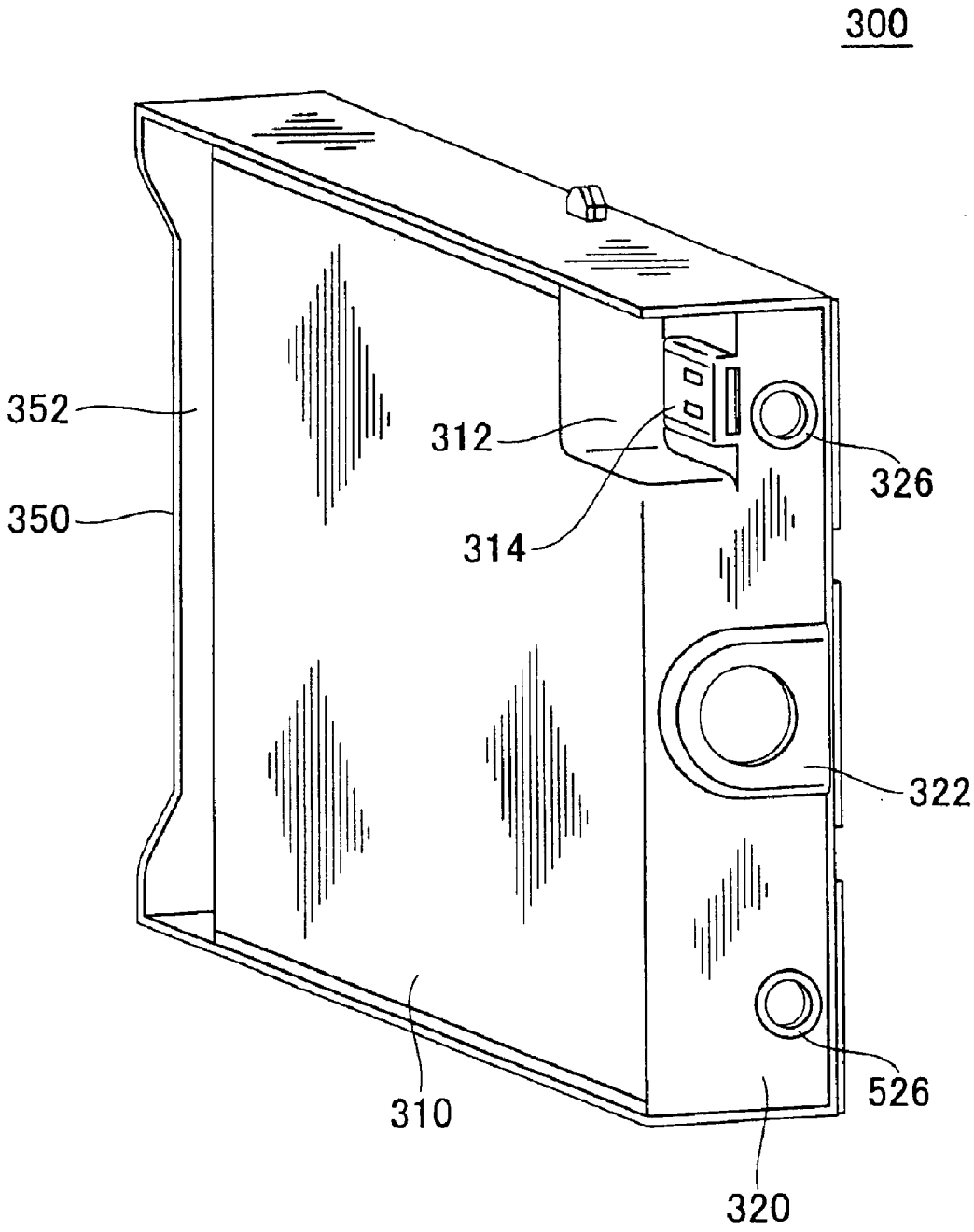
FIG. 2 is a front perspective view of an ink cartridge according to the first embodiment of the present invention.

FIG. 2 is a front perspective view of the ink cartridge 300 that is a liquid cartridge according to an embodiment of the present invention. This ink cartridge 300 can be mounted on the ink-jet recording apparatus 10 that is a liquid ejecting apparatus shown in FIGS. 1A and 1B. However, the present invention is not limited to the above. Another example of the liquid ejecting apparatus is a color-filter fabrication apparatus for fabricating a color filter for use in a liquid crystal display. In this case, a color-material ejection head of the color-filter fabrication apparatus is an exemplary liquid ejecting head. Still another example of the liquid ejecting apparatus is an electrode forming apparatus for forming electrodes in an organic EL display, a field-emission display (FED) and the like. In this case, an electrode-material (conductive paste) ejection head is an exemplary liquid ejecting head. Still another example of the liquid ejecting apparatus is a bio-chip fabrication apparatus for fabricating bio-chips. In this case, a bioorganic compound ejection head of the bio-chip fabrication apparatus and a sample spraying head as a precision pipette are exemplary liquid ejecting heads. The liquid ejecting apparatus of the present invention includes other liquid ejecting apparatus used in applications in various industries.

The ink cartridge 300 of the present embodiment is provided with a check valve mechanism in order to prevent air from getting into an ink accommodating part 306,that is a liquid accommodating member of the ink cartridge 300, from the outside when the ink accommodating part 306 has been opened to the atmosphere, as described later. Moreover, the ink cartridge 300 of the present embodiment is arranged to allow backward flow of ink, that is an example of liquid, from the recording head 205 of the ink-jet recording apparatus 10 to the ink accommodating part 306 of the ink cartridge 300 while the ink cartridge 300 is connected to the main body 100 of the ink-jet recording apparatus 10. This arrangement of the ink cartridge 300 can allow the backward flow of ink toward the ink accommodating part 306 with extending/bending of the ink transfer path 203 while the ink cartridge 300 is connected to the main body 100, and can prevent ink oversupply to the main body 100, which may cause falling of ink drops from the recording head 205 or a damage of the recording head 205 by the increased pressure of ink.

As shown in FIG. 2, the ink cartridge 300 has a substantially rectangular shape. The ink cartridge 300 includes an information storing unit 314 provided in a recess 312 in the first side wall 310, an ink supply unit 322 provided in a front surface 320 that intersects with the first side wall 310, and positioning portions 326, 526 provided in the front surface 320.

Each of the positioning portions 326, 526 receives a corresponding corner provided in the cartridge holder 200, so as to position the ink cartridge 300 with respect to the cartridge holder 200.

The information storing unit 314 of the ink cartridge 300 stores information on the type of ink cartridge, color of ink held by the ink cartridge 300, the remaining amount of ink, and the like. An example of the information storing unit 314 is a contact-type IC chip.

The ink cartridge 300 further includes a grip portion 350 and a dent 352 on the back thereof. These allow the user to surely grip the ink cartridge 300 and therefore make it easier to attach and remove the ink cartridge 300 to/from the cartridge holder 200 of the ink-jet recording apparatus 10.

Figure 3:
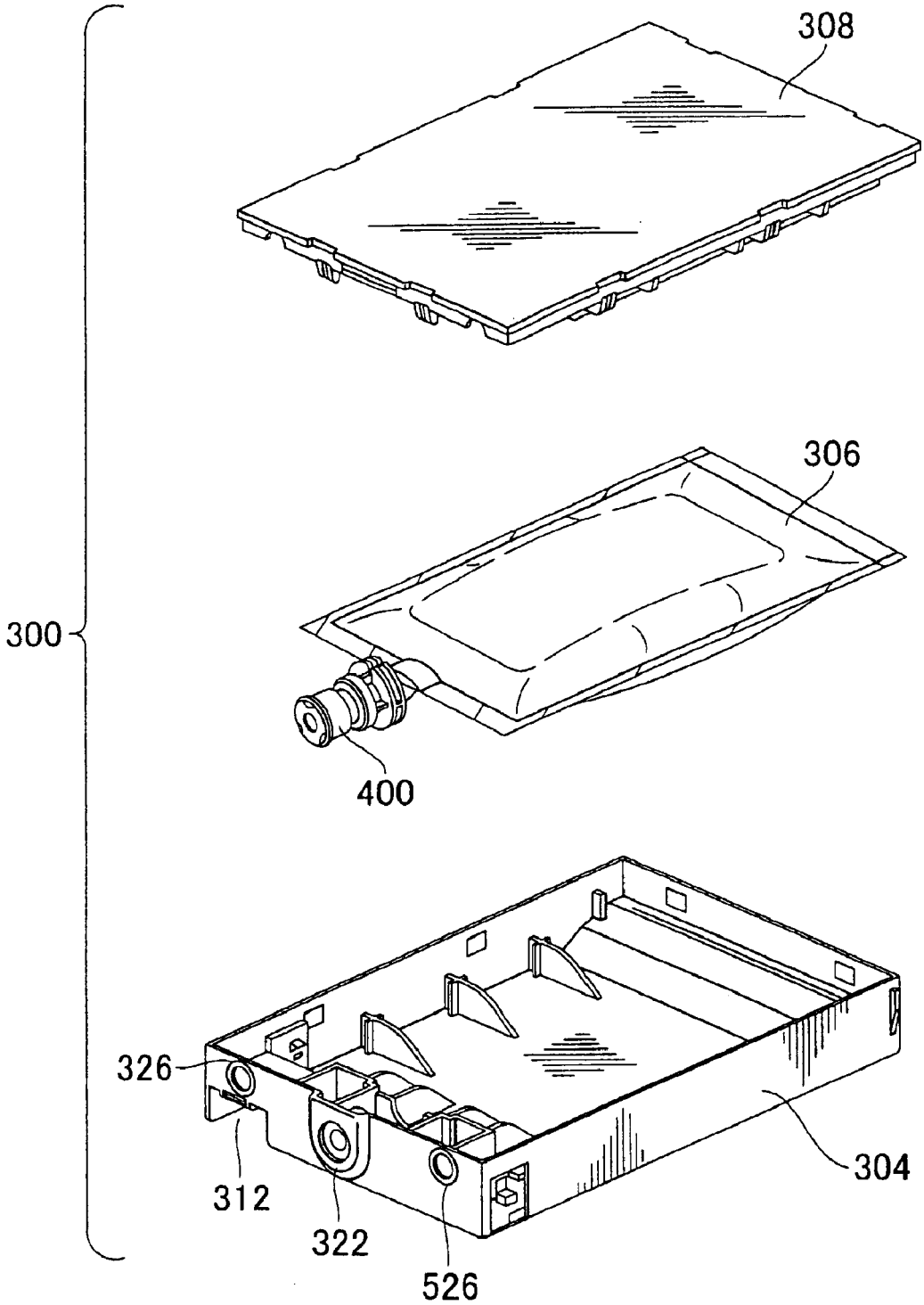
FIG. 3 is an exploded perspective view of the ink cartridge.

FIG. 3 is an exploded perspective view of the ink cartridge 300. The ink cartridge 300 includes a container main body 304 having an opening on one side, an ink bag 306 having a channel 400 formed at one end thereof, and a cover part 308 in form of substantially flat plate. In the present embodiment, the ink bag 306 is an exemplary ink accommodating member, and is formed of flexible material such as polyethylene. The ink bag 306 is filled with ink. Then, the ink bag 306 with the ink is accommodated in the ink cartridge 300 and the channel 400 formed at one end of the ink bag 306 is fixed to the ink supply unit 322. Then, the cover part 308 is fixed to cover the opening of the container main body 304 with the ink bag 306 accommodated therein by, for example, vibration welding.

Figure 4A:
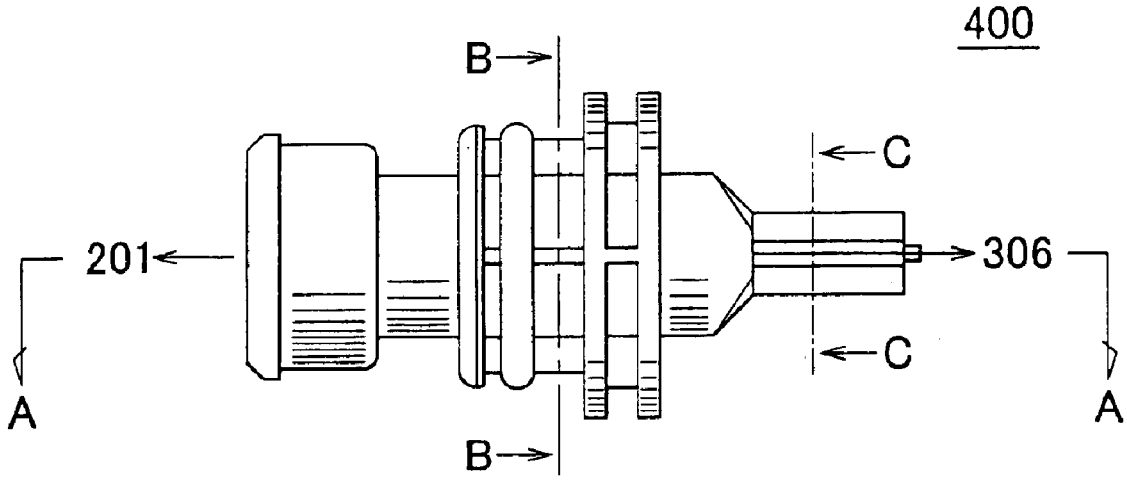
FIG. 4A is a side view of a channel in the ink cartridge according to the embodiment of the present invention.
Figure 4B:
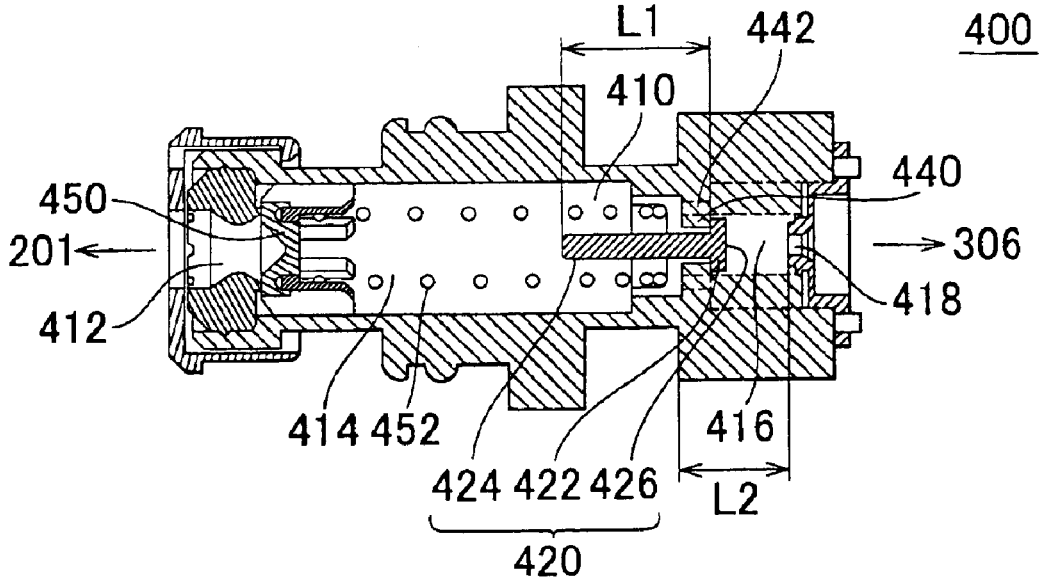
FIGS. 4B, 4C and 4D are cross-sectional views of the channel, taken along lines A—A, B—B and C—C in FIG. 4A, respectively.
Figure 4C:
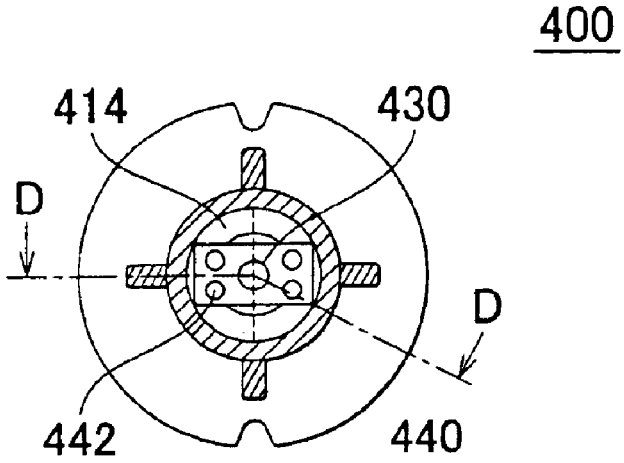
Figure 4D:
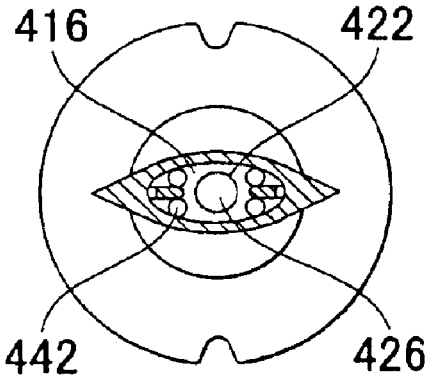
Figure 4E:
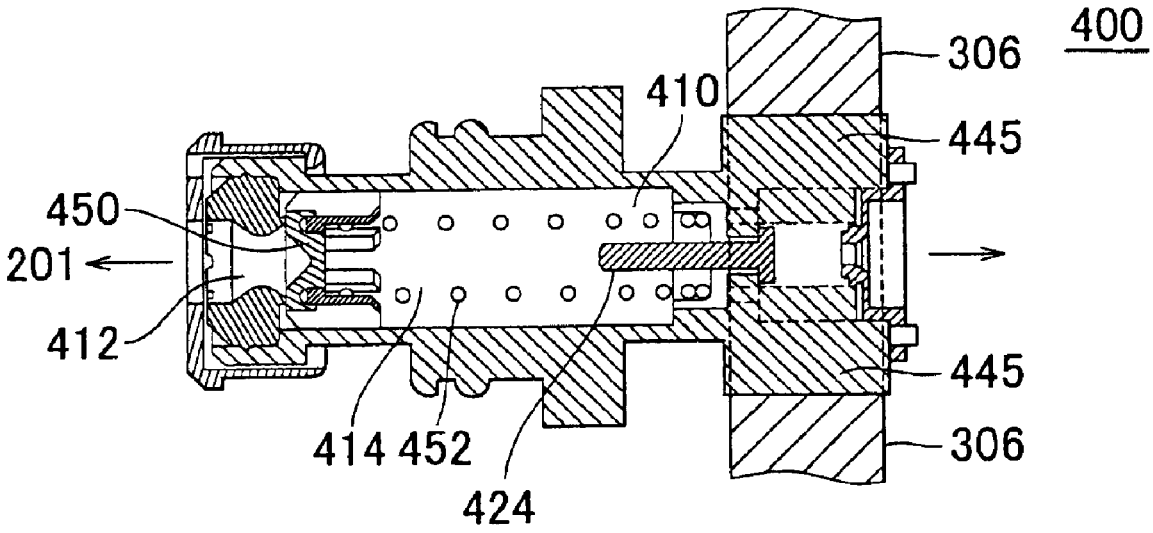
FIG. 4E is a plan view for explaining connection between the channel and an ink bag.

FIGS. 4A, 4B, 4C and 4D are an enlarged view and cross-sectional views of the channel 400. FIG. 4A is a side view of the channel 400, and FIGS. 4B, 4C and 4D are cross-sectional views of the channel 400 taken along lines A—A, B—B and C—C in FIG. 4A, respectively. Moreover, FIG. 4E is a plan view for explaining connection between the channel 400 and the ink bag 306.

As shown in FIGS. 4A–4D, the channel 400 has a bag opening 418 as an accommodating-part opening that can communicate with the inside of the ink bag 306 and an external opening 412 that can communicate with the ink-jet recording apparatus 10, thereby forming a flow path 410 along which ink in the ink bag 306 is allowed to flow to the ink-jet recording apparatus 10. The channel 400 is formed of, for example, polyethylene, and is connected to the ink bag 306 by heat welding or the like. More specifically, as shown in FIG. 4E, the channel 400 is welded at an welded portion 445 thereof by heat to flexible material forming the ink bag 306.

The ink cartridge 300 includes a check valve 420 in the channel 400. The check valve 420 has a valve main body 422 that can prevent the backward flow of ink from the channel 400 to the ink bag 306 by moving in the opposite direction (to the right in FIG. 4B) to the ink supply direction and closing the bag opening 418. The valve main body 422 includes a larger-diameter portion of a disk-like shape, for example, and also includes a contact surface 426 that can be brought into contact with the bag opening 418. The check valve 420 further includes a guide 424 extending from the valve main body 422 in the ink supply direction by a distance L1 larger than the sum L2 of the movable distance of the valve main body 422 and the thickness of a guide holding portion 440. The guide 424 has a substantially cylindrical shape having a smaller diameter than that of the valve main body 422. In the present embodiment, it is preferable that the check valve 420 be formed of material having larger specific gravity than that of ink as described later.

Moreover, it is preferable that the check valve 420 be formed of material having higher melting point than those of materials for the channel 400 and the ink bag 306. In this case, it is possible to prevent the check valve 420 from adhering to the interior of the channel 400 in heat welding of the channel 400 and the ink bag 306. In a case where the channel 400 and the ink bag 306 are formed of polyethylene as in the present embodiment, the check valve 420 may be formed of polypropylene that is an example of material having higher melting point than polyethylene. Other examples of the material for the check valve 420 are polyacetal and stainless steel. In general, high-density polyethylene has melting point in the range of 126° C.–137° C. and specific gravity in the range of 0.94–0.97; polypropylene has melting point in the range of 165° C.–208° C. and specific gravity in the range of 0.90–0.91; polyacetal has melting point in the range of 175° C.–200° C. and specific gravity of 1.42; and stainless steel has melting point in the range of 1510° C.–1532° C. and specific gravity in the range of 7.60–7.65. The specific gravity of ink is typically about 1.1 in a case of aqueous ink that contains water as a solvent (the above-listed values were obtained referring to Japanese Standard Association: "Non-metallic material data book" and Japan Society of Mechanical Engineers: "Mechanical Engineering Manual").

The channel 400 has the guide holding portion 440 that is provided between the bag opening 418 and the external opening 412 for holding the guide 424 of the check valve 420 in such a manner that the guide 424 can freely slide in the ink supply direction and the direction opposite thereto. In the present embodiment, the guide holding portion 440 has a guide bore 430 to which the guide 424 is to be inserted, and holds the guide 424 inserted to the guide bore 430.

In the channel 400 of the present embodiment, the flow path 410 is formed in such a manner that the flow path part 414 on the external-opening side of the guide holding portion 440 is larger in cross-sectional area of the flow path than the flow path part 416 on the bag-opening side of the guide holding portion 440.

The ink cartridge 300 further includes a detour path 442 that allows communication with the bag opening 418 and the flow path part 414 on the external-opening side while the valve main body 422 of the check valve 420 does not close the bag opening 418.

The ink cartridge 300 further includes a supply valve 450 arranged in the flow path 410 at such a position that the supply valve 450 is closer to the external opening 412 than the check valve 420. The supply valve 450 is forced by a spring 452 toward the external opening 412 so as to prevent unwanted ink leak through the external opening 412. When the ink cartridge 300 has been mounted onto the cartridge holder 200 of the ink-jet recording apparatus 10 and therefore the supply valve 450 has been moved toward the bag opening 418 against the force applied by the spring 452, the supply valve 450 opens the external opening 412.

Figure 5A:
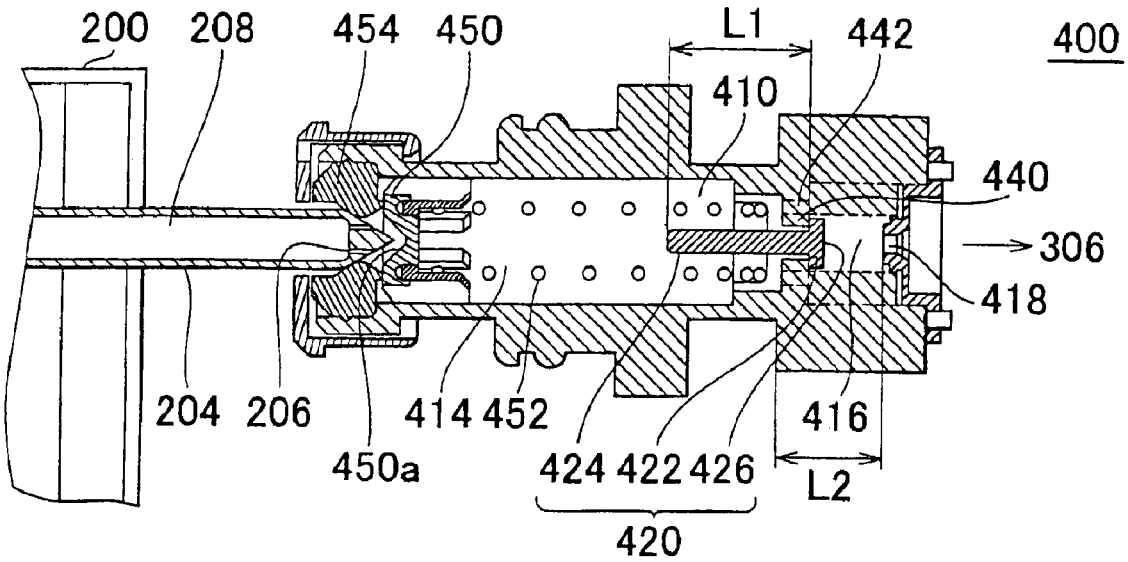
FIGS. 5A and 5B are cross-sectional views of the channel, showing a process in which a supply valve is forcedly opened by an ink-supply needle.
Figure 5B:
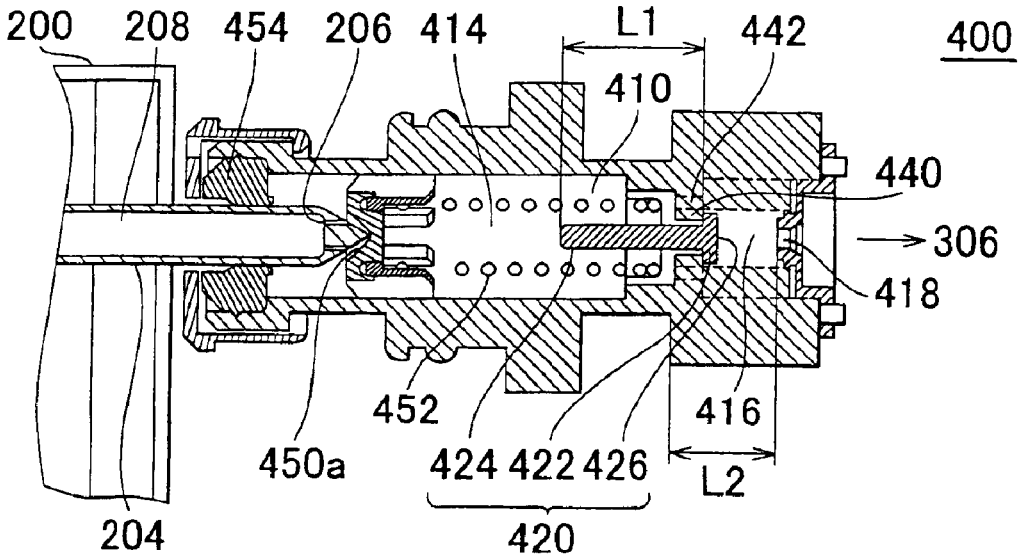

FIGS. 5A and 5B are drawings corresponding to FIG. 4B, and show the process in which a hollow ink-supply needle 204 extending from the cartridge holder 200 of the ink-jet recording apparatus 10 opens the supply valve 450. FIG. 5A shows a state in which the ink-supply needle 204 has been inserted into the external opening 412 to come into contact with a packing member 454 provided in the external opening 412 by press fitting, so that the ink-supply needle 204 is sealed to prevent ink leakage. In this state, the ink-supply needle 204 has not reached a recess 450*a* yet, and therefore the supply valve 450 is pressed by the spring 452 against the packing member 454, thereby achieving tight sealing to prevent ink leak. Thus, the ink in the flow path part 414 cannot leak into the external opening 412.

Then, as shown in FIG. 5B, the ink-supply needle 204 fits into the recess portion 450*a* of the supply valve 450 to move the supply valve 450 against the force applied by the spring 452 toward the ink bag 306. During this movement, the ink in the flow path part 414 cannot leak to the outside because the ink-supply needle 204 maintains the state sealed by the packing member 454 while the packing member 454 is deformed. The ink-supply needle 204 is provided with a communication hole 206 through which the ink can flow into an ink passage 208 within the ink-supply needle 204. As described above, by the movement of the supply valve 450 against the force applied by the spring 452 toward the bag opening 418, the supply valve 450 opens the external opening 412.

Figure 6A:
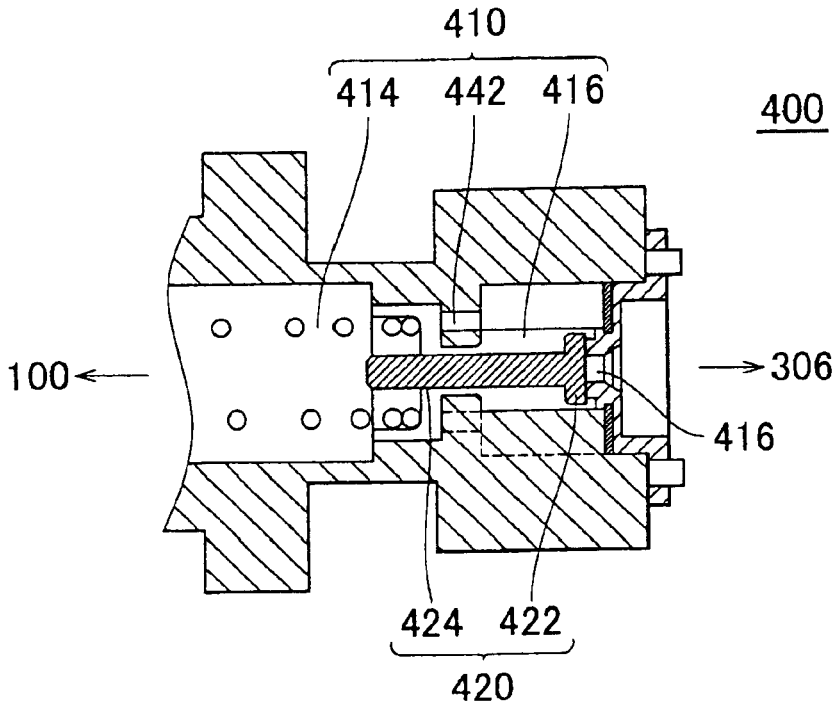
FIGS. 6A, 6B and 6C are sequential cross-sectional views of the channel taken along line D—D in FIG. 4C, showing an operation of a check valve in the ink cartridge.
Figure 6B:
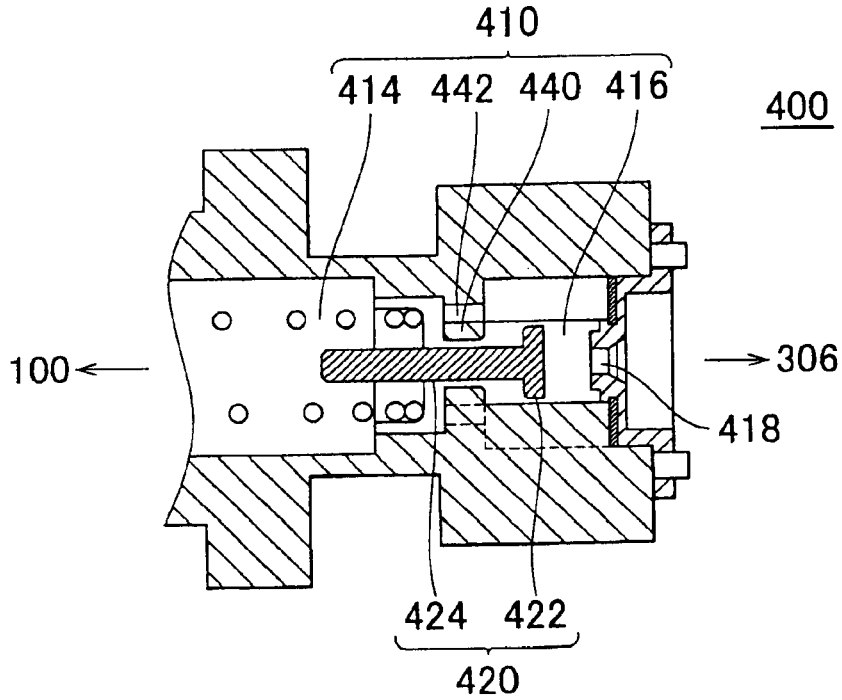
Figure 6C:
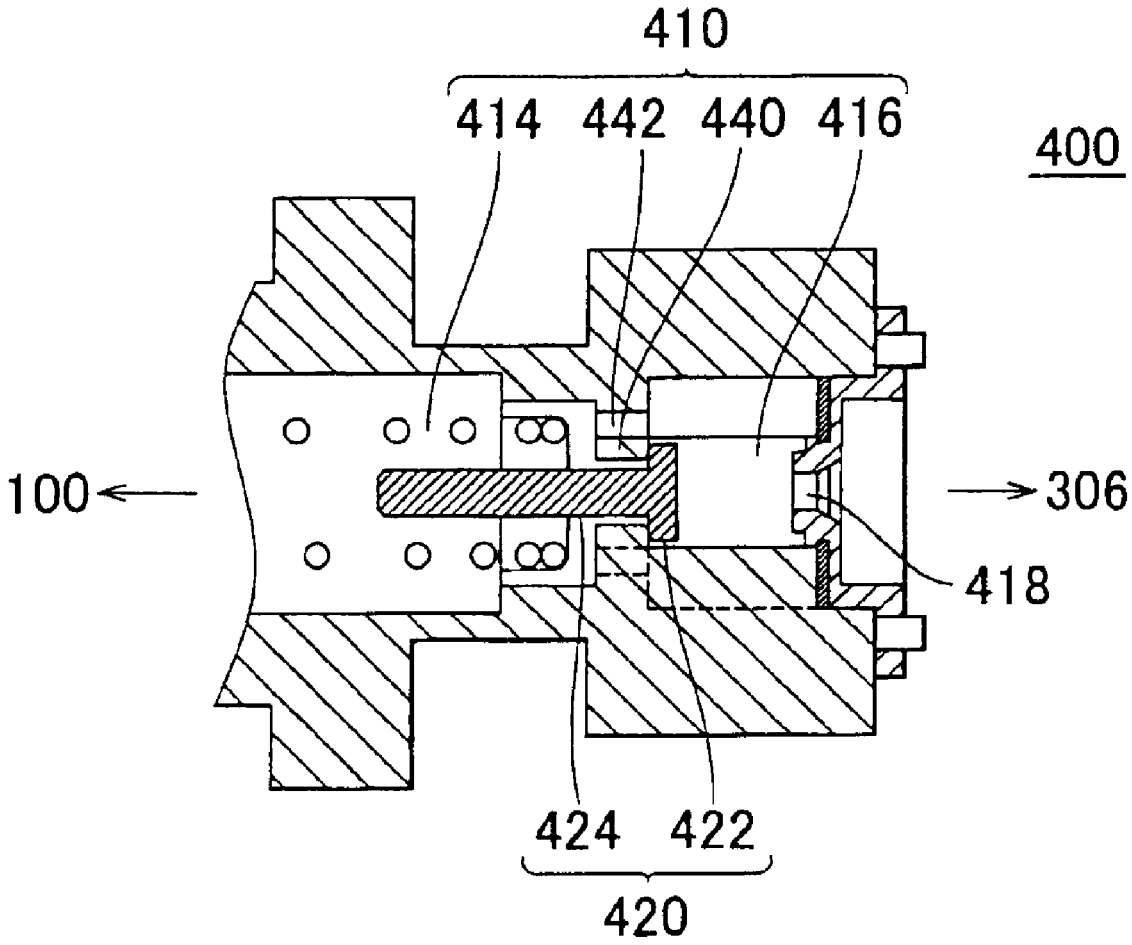

FIGS. 6A, 6B and 6C are cross-sectional views taken along line D—D in FIG. 4C, showing the operation of the check valve 420 in the channel 400 of the ink cartridge 300. First, the ink cartridge 300 is mounted onto the cartridge holder 200 of the ink-jet recording apparatus 10 while keeping a posture in which the flow path 410 of the channel 400 is placed horizontally (i.e., the posture shown in FIG. 2). Thus, the channel 400 of the ink cartridge 300 is connected to the main body 100 of the ink-jet recording apparatus 10. Also, the supply valve 450 is moved toward the bag opening 418 against the force applied by the spring 452, thereby opening the external opening 412.

While the ink cartridge 300 mounted on the cartridge holder 200 is in the state shown in FIG. 6A, when ink supply has been requested from the recording head 205 of the main body 10 of the ink-jet recording apparatus 10, the check valve 420 moves along the ink supply direction (to the left in FIG. 6A).

Thus, the check valve 420 opens the bag opening 418, as shown in FIG. 6B, thereby allowing ink from the ink bag 306 to be supplied to the flow path 410 through the bag opening 418. In the present embodiment, the ink held in the ink bag 306 is supplied via the bag opening 418 to the flow path part 416 on the bag-opening side of the guide holding portion 440 and is then supplied to the flow path part 414 on the external-opening side of the guide holding portion 440 through the detour path 442. The ink is then supplied via the external opening 412 to the ink transfer path 203 in the main body 100 of the ink-jet recording apparatus 10.

When the check valve 420 further moved along the ink supply direction, the valve main body 422 of the check valve 420 comes into contact with the guide holding portion 440 of the channel 400, as shown in FIG. 6C. In this state, the guide holding portion 440 prevents further movement of the check valve 420 along the ink supply direction.

In the state shown in FIG. 6C, the ink held in the ink bag 306 is supplied to the ink transfer path 203 of the main body 100, so that the ink is emitted from the recording head 205 connected to the ink transfer path 203. In a so-called off-carriage type ink-jet recording apparatus 10 in which the cartridge holder 200 does not move with the scan of the recording head 205, such as the ink-jet recording apparatus 10 of the present embodiment, the ink transfer path 203 such as a flexible tube, is bent and extended by the scan of the recording head 205. Such extending or bending of the ink transfer path 203 causes the ink in the ink transfer path 203 to flow in the ink supply direction or the opposite direction thereto.

In a case where the ink in the ink transfer path 203 is caused to flow in the ink supply direction, more ink is supplied from the ink bag 306 to the ink transfer path 203 through the channel 400. In this case, if the check valve 420 is in the state shown in FIG. 6A, it moves to a position shown in FIG. 6C at a stretch.

On the other hand, in a case where the ink in the ink transfer path 203 is caused to flow in the opposite direction to the ink supply direction, the ink in the ink transfer path 203 flows toward the channel 400. In this case, the ink in the ink transfer path 203 flows back to the flow path part 414 via the external opening 412, and then flows back to the flow path part 416 through the detour path 442. Since the check valve 420 leaves the bag opening 418 open, as shown in FIG. 6C, the ink is allowed to flow from the flow path part 416 to the ink bag 306 via the bag opening 418. Thus, the ink is accommodated in the ink bag 306.

In the present embodiment, the guide holding portion 440 comes into contact with the valve main body 422 when the check valve 420 moved along the ink supply direction, thereby preventing the backward flow of ink from applying a force directly to the check valve 420 to move it in the opposite direction to the ink supply direction. Thus, while the ink cartridge 300 is connected to the main body 100 of the ink-jet recording apparatus 10, the backward ink flow to the ink bag 306 caused by the extending and bending of the ink transfer path 203 is allowed without closing the bag opening 418. Therefore, it is possible to prevent oversupply of ink to the main body 100, which may cause falling of ink drops from the recording head 205 or a damage of the recording head 205 by increased pressure of the ink.

In the present invention, the check valve 420 is arranged in such a manner that the valve main body 422 thereof can move within an appropriately set movable distance, for example, the distance corresponding to four to five times the thickness of the valve main body 422, in order to keep the bag opening 418 opened and allow the backward ink flow even if the check valve 420 was moved toward the bag opening 418 by the backward ink flow. The check valve 420 that was moved back to a position closer to the bag opening 418 by the backward ink flow is moved again to the position shown in FIG. 6C by the ink flow in the ink supply direction. Therefore, the bag opening 418 cannot be closed.

The guide 424 of the check valve 420 has such a length that it projects from the guide holding portion 440 in the ink supply direction even in the state shown in FIG. 6A. Therefore, the valve main body 422 of the check valve 420 can move within the aforementioned movable distance surely, while keeping a desired posture.

Moreover, in the present embodiment, when the check valve 420 moved along the ink supply direction to be placed in the state shown in FIG. 6C, the guide 424 projects into the flow path part 414. However, since the cross-sectional area of the flow path part 414 that is a closer part to the external opening 412 is larger than that of the flow path part 416 that is a closer part to the bag opening 418, as can be seen in FIGS. 4C and 4D, the velocity of ink flow is smaller in the flow path part 414 than in the flow path part 416. This makes it harder to move the check valve 420 toward the bag opening 418 in a case where the ink flows in the backward direction.

Next, the operation for preventing the backward ink flow while the ink cartridge 300 is not connected to the main body 100 is described referring to FIGS. 4B and 6A–6C.

In the following description, a case is assumed where the user forcedly opens the supply valve 450. In this case, the user generally holds the ink cartridge 300 in such a posture that the channel 400 having the supply valve 450 therein is located at the upper part of the ink cartridge 300. In other words, this posture includes all postures in which the channel 400 is placed to lift up the external opening higher than the bag opening. Once air from the outside has got into the ink bag 306 while the supply valve 450 was forced to move away in the ink cartridge 300 held in such a posture, even if the ink cartridge 300 has been mounted to the main body 100 of the ink-jet recording apparatus 10 thereafter, ink may not be supplied from the ink cartridge 300 to the main body 100 in an appropriate manner.

Thus, the check valve 420 of the present embodiment prevents the air from getting into the ink bag 306 via the channel 400 in a case where the ink bag 306 was opened to the atmosphere with the channel 400 faced upward. Because the check valve 420 is arranged inside the channel 400 slidably in the ink supply direction and the opposite direction thereto, when the ink cartridge 300 is placed in such a posture that the channel 400 is located at the upper part of the ink cartridge 300, the check valve 420 goes down, i.e., moves toward the bag opening 418 because of the rapid ink flow in the downward direction. This is because the ink bag 306 is formed of flexible material such as polyethylene or aluminum foil. In other words, when the ink cartridge 300 is placed vertically so that the channel 400 is located at the upper part thereof, the ink inside the channel 400 rapidly moves downward by its weight. As a result, the flow path part 416 on the bag-opening side in the channel 400 is placed on a state where a strong negative pressure is applied. Due to this negative pressure, the check valve 420 moves at a stretch to such a position that the check valve 420 is in contact with the bag opening 418, as shown in FIG. 6A, even if the check valve 420 was located at the position shown in FIG. 6B or 6C, thereby the contact surface 426 of the valve main body 422 blocks the bag opening 418. Therefore, leak of air into the ink bag 306 can be prevented even if the user forcedly opens the supply valve 450, because the check valve 420 strongly closes the bag opening 418.

As described above, the check valve 420 of the present embodiment has such specific gravity that the check valve 420 is not moved by the flow velocity of the backward flow of ink from the recording head 205 caused by bending or extending of the ink transfer path 203 but is moved at a stretch by the flow velocity given by the negative pressure applied to the flow path part 416 when the ink bag 306 is placed vertically. The material is specifically chosen considering a relative relationship with ink as liquid. When the relationship with ink of the ink-jet recording apparatus 10 of the present embodiment is considered, the above-mentioned materials are suitable.

Moreover, in a case where the check valve 420 is formed of material having larger specific gravity than that of ink in the present embodiment, when the ink cartridge 300 is placed in the posture in which the channel 400 is located at the upper part of the ink cartridge 300, the check valve 420 moves down by its weight more rapidly than the backward ink flow so as to reach the position shown in FIG. 6A. Therefore, it is possible to prevent leak of air into the ink bag 306 more rapidly and steadily.

Figure 7A:
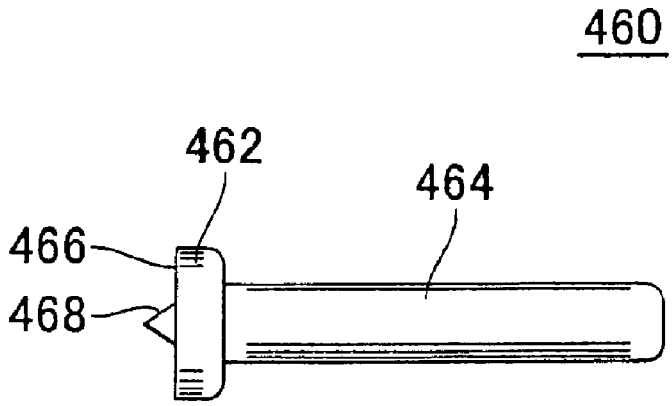
FIGS. 7A and 7B are side and back views of another exemplary check valve of the ink cartridge.
Figure 7B:
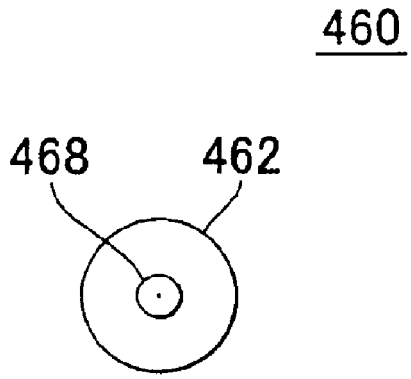

FIGS. 7A and 7B are side and back views of another exemplary check valve 460 of the ink cartridge 300 according to the present embodiment. The check valve 460 has a valve main body 462, a guide 464 and a contact surface 466 as is the case with the check valve 420 shown in FIG. 4B. The contact surface 466 of the check valve 460 includes a projection 468 tapered off on the side of the contact surface 466 closer to the bag opening 418. This arrangement allows the projection 468 to enter the bag opening 418 when the check valve 460 has moved toward the bag opening 418, thereby guiding the check valve 460 to close the bag opening 418 with the contact surface 466 without fail.

Figure 8A:
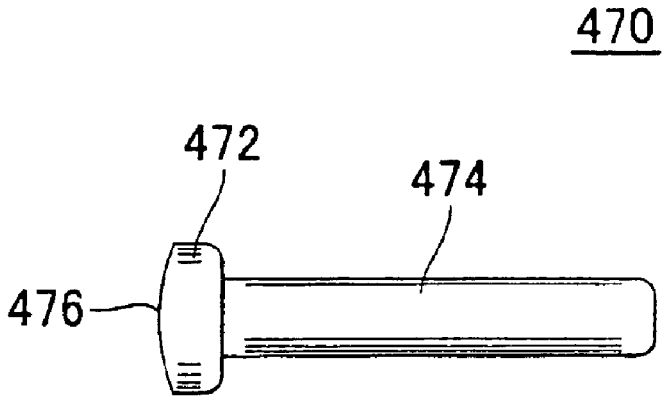
FIGS. 8A and 8B are side and back views of still another exemplary check valve of the ink cartridge.
Figure 8B:
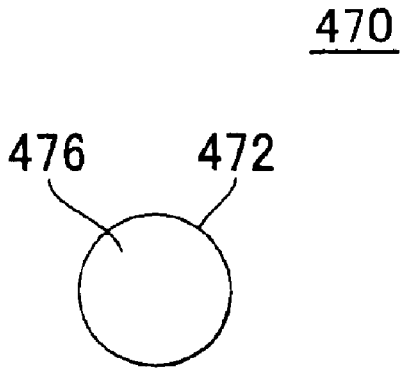

FIGS. 8A and 8B are side and back views of still another exemplary check valve 470 of the ink cartridge 300 of the present embodiment. The check valve 470 has a valve main body 472, a guide 474 and a contact surface 476 as is the case with the check valve 420 shown in FIG. 4B. The contact surface 476 has a curved face that becomes convex toward the bag opening 418. This arrangement can reduce the area of contact between the contact surface 476 and the periphery of the bag opening 418 so as to increase the pressure with which the contact surface 476 seals the bag opening 418, and also allows the contact surface 476 to push evenly the periphery of the bag opening 418. Therefore, the contact surface 476 and the bag opening 418 are brought into contact with each other more steadily, thereby preventing air from the outside from entering more effectively.

In the above embodiment, the present invention was described by referring to the ink cartridge 300 accommodating the ink bag 306 in the box-like container body 304 and cover part 308. However, the present invention can be applied to such a type of ink bag that the ink bag can be mounted and removed onto/from a tray of the main body 100 of the ink-jet recording apparatus 10.

Moreover, the present invention may be applied to an ink cartridge in which the ink accommodating member is formed by an accommodating member having at least one opened face sealed with a flexible film that is deformable in accordance with the ink consumption, with the channel of the ink cartridge formed in the accommodating member.

As described above, according to the present embodiment, in a case where the ink bag 306 of the ink cartridge 300 is opened to the atmosphere because of wrong operation by the user, it is possible to prevent air from leaking into the ink bag 306 from the outside. Moreover, according to the present embodiment, backward flow of ink from the ink-jet recording apparatus 10 to the ink bag 306 can be allowed while the ink cartridge 300 is connected to the ink-jet recording apparatus 10.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid cartridge for supplying liquid held therein to a liquid ejecting apparatus, comprising:

a liquid accommodating part operable to hold said liquid;

a channel operable to communicate with said liquid accommodating part to allow said liquid accommodated in said liquid accommodating part to flow to an outside of said ink accommodating part; and a check valve, provided in said channel, operable to prevent air from getting into said liquid accommodating part via said channel in a case where said channel is opened to atmosphere with said channel faced upward, and to allow backward flow of said liquid from said liquid ejecting recording apparatus to said liquid accommodating part while said channel is connected to said liquid ejecting apparatus.

2. A liquid cartridge for supplying liquid held therein to a liquid ejecting apparatus, comprising:

a liquid accommodating part operable to hold said liquid;

a channel, having an accommodating-part opening communicatable with an inside of said liquid accommodating part and an external opening communicatable with said liquid ejecting apparatus, operable to allow said liquid in said liquid accommodating part to flow to said liquid ejecting apparatus;

a check valve having a valve main body and a guide, said valve main body preventing air from getting into said liquid accommodating part via said channel by moving in a direction opposite to a direction of liquid supply to close said accommodating-part opening, said guide extending from said valve main body in said direction of liquid supply by a distance longer than a movable distance of said valve main body; and a guide holding portion, provided in said channel between said accommodating-part opening and said external opening, operable to hold said guide slidably in said liquid supply direction and said opposite direction to said liquid supply direction.

3. A liquid cartridge as claimed in claim 2, further comprising a detour path operable to allow communication between said accommodating-part opening and said external opening in a state where said valve main body of said check valve does not close said accommodating-part opening.

4. A liquid cartridge as claimed in claim 2, wherein said guide holding portion comes into contact with said valve main body when said check valve moved in said liquid supply direction, to prevent said liquid flowing backward from moving said check valve in said opposite direction to said liquid supply direction.

5. A liquid cartridge as claimed in claim 2, wherein said check valve is formed of material having larger specific gravity than material for said liquid.

6. A liquid cartridge as claimed in claim 2, wherein said check valve is formed of material having higher melting point than materials for said channel and said liquid accommodating part.

7. A liquid cartridge as claimed in claim 6, wherein said check valve is formed of polypropylene and said channel and said liquid accommodating part are formed of polyethylene.

8. A liquid cartridge as claimed in claim 2, wherein said guide projects from said guide holding portion toward said external opening at least when said check valve moved in said liquid supply direction, and said channel has a larger cross-sectional area on an external-opening side of said guide holding portion than on an accommodating-part-opening side of said guide holding portion.

9. A liquid cartridge as claimed in claim 2, further comprising a supply valve, arranged in said channel on an external-opening side of said check valve, operable to supply said liquid to said liquid ejecting apparatus by receiving a liquid-supply needle of said liquid ejecting apparatus inserted thereto.

10. A liquid cartridge as claimed in claim 2, wherein said valve main body has a contact surface capable of coming into contact with said accommodating-part opening.

11. A liquid cartridge as claimed in claim 10, wherein said contact surface has a projection tapered off toward said accommodating-part opening.

12. A liquid cartridge as claimed in claim 10, wherein said contact surface has a curved surface that becomes convex toward said accommodating-part opening.

13. A liquid accommodating member for supplying liquid to a liquid ejecting apparatus, comprising:

a flexible main body operable to hold said liquid;

a channel, provided in said flexible main body, operable to allow said liquid to flow to an outside of said flexible main body; and a check valve, provided in said channel, operable to prevent air from getting into said flexible main body via said channel in a case where said channel is opened with said channel faced upward, and to allow backward flow of said liquid from said liquid ejecting apparatus to said flexible main body while said channel is connected to said liquid ejecting apparatus.

14. A liquid cartridge for supplying liquid accommodated therein to a liquid ejecting apparatus, comprising:

a box-like cartridge main body operable to be removably attached to said liquid ejecting apparatus;

a flexible liquid accommodating part, accommodated in said cartridge main body, operable to hold said liquid;

a channel operable to communicate with an inside of said liquid accommodating part to allow said liquid accommodated in said liquid accommodating part to flow to an outside of said liquid accommodating part; and a check valve, provided in said channel, operable to prevent air from getting into said liquid accommodating part via said channel in a case where said channel is opened to atmosphere with said channel faced upward, and to allow backward flow of said liquid from said liquid ejecting apparatus to said liquid accommodating part while said channel is connected to said liquid ejecting apparatus.

* * * * *